US006797121B2

(12) United States Patent
Hyvönen et al.

(10) Patent No.: US 6,797,121 B2
(45) Date of Patent: Sep. 28, 2004

(54) PRESS FELT STRUCTURE AND METHOD OF MANUFACTURING PRESS FELT

(75) Inventors: Kari Hyvönen, Tampere (FI); Heikki Rehakka, Tampere (FI); Tauno Virtanen, Tampere (FI)

(73) Assignee: Tamfelt Oyj ABP, Tampere (FI)

( * ) Notice: Subject to any disclaimer, the term of this patent is extended or adjusted under 35 U.S.C. 154(b) by 0 days.

(21) Appl. No.: 10/438,895

(22) Filed: May 16, 2003

(65) Prior Publication Data

US 2004/0020622 A1 Feb. 5, 2004

Related U.S. Application Data

(63) Continuation of application No. PCT/FI01/01123, filed on Dec. 19, 2001.

(30) Foreign Application Priority Data

Dec. 18, 2000 (FI) ..... 20002772

(51) Int. Cl.[7] ..... D21F 7/08; D21F 7/10

(52) U.S. Cl. ..... 162/358.2; 162/900; 162/904; 442/270; 442/239; 442/247; 428/60; 428/192

(58) Field of Search ..... 162/358.1, 358.2, 162/900, 902–4, 199, 348; 428/57–62, 192–193, 212, 222–223; 442/268–275, 203–208, 239–241, 246, 247; 28/110, 141, 142; 34/116, 123; 139/383 A, 383 AA, 425 A

(56) References Cited

U.S. PATENT DOCUMENTS

| | | | | | |
|---|---|---|---|---|---|
| 3,393,115 | A | | 7/1968 | Hainsworth et al. | |
| 4,090,897 | A | | 5/1978 | Minick | |
| 4,311,172 | A | * | 1/1982 | Eckstein | 139/383 AA |
| 4,541,895 | A | * | 9/1985 | Albert | 162/348 |
| 4,698,250 | A | * | 10/1987 | Talonen et al. | 428/58 |
| 4,863,786 | A | * | 9/1989 | Green et al. | 442/241 |
| 5,110,672 | A | * | 5/1992 | Zehle et al. | 442/240 |
| 5,879,777 | A | * | 3/1999 | Shipley | 428/100 |
| 5,904,187 | A | * | 5/1999 | Davenport | 139/383 AA |
| 6,124,015 | A | * | 9/2000 | Baker et al. | 428/99 |
| 6,213,164 | B1 | * | 4/2001 | Ostermayer et al. | 139/383 AA |
| 6,440,881 | B1 | * | 8/2002 | Ercken | 442/320 |

FOREIGN PATENT DOCUMENTS

| | | | | |
|---|---|---|---|---|
| EP | 0 012 219 A1 | | 6/1980 | |
| EP | 0 101 202 A2 | | 2/1984 | |
| EP | 0 367 614 A2 | | 5/1990 | |
| EP | 0 802 280 A3 | | 10/1997 | |
| FI | 80092 B | | 4/1990 | |
| WO | WO 99/19564 | * | 4/1999 | D21F/7/10 |

* cited by examiner

*Primary Examiner*—Peter Chin
*Assistant Examiner*—Eric Hug
(74) *Attorney, Agent, or Firm*—Oliff & Berridge, PLC

(57) ABSTRACT

A method of manufacturing a press felt, a press felt and a base fabric. The press felt comprises a base fabric with a batt fiber layer attached on at least the surface facing a paper web. The base fabric is a laminate comprising at least two separate layers. For the base fabric, one or more base fabric modules are provided, which are assembled with a butt seam into a closed loop.

13 Claims, 4 Drawing Sheets

PRESS FELT STRUCTURE AND METHOD OF MANUFACTURING PRESS FELT

This is a Continuation of International Application No. PCT/FI01/01123 filed Dec. 18, 2001. The entire disclosure of the prior application is hereby incorporated by reference herein in its entirety.

FIELD OF THE INVENTION

The invention relates to a method of manufacturing a press felt, the method comprising forming a laminated base fabric having at least two superimposed, independent, woven layers, each layer having its own warp yarns and weft yarns; assembling the base fabric from one or more base fabric modules into one closed loop; providing for assembly jointing edges at the opposing edges of the base fabric; and attaching at least one batt fibre layer to the base fabric after the assembly.

The invention further relates to a press felt, which comprises a woven base fabric and at least one batt fibre layer, and in which the base fabric comprises at least two superimposed, independent layers, each layer having its own warp yarns and weft yarns, the base fabric further comprising at least one base fabric module, which base fabric module is provided with necessary jointing edges, of which jointing edges one or more base fabric modules are joined into a closed loop base fabric.

The invention also relates to a base fabric, which comprises at least two superimposed, independent layers, each layer having its own warp yarns and weft yarns, and which base fabric comprises at least one base fabric module which is provided with necessary jointing edges, of which jointing edges one or more base fabric modules are joined into a closed loop base fabric.

BACKGROUND OF THE INVENTION

The aim of a press section in a paper machine is to drain a web as efficiently as possible without causing any deterioration in the quality of the web, however. From the viewpoint of energy consumption, it is most advantageous to remove as much water as possible already at the press section, whereby there is less need to dry the paper web at subsequent sections of the paper machine. Depending on the press structure, the press section of the paper machine employs a press felt on one or both sides of the web to be dried, into which press felt the water in the web is absorbed. The purpose of the press felt is to transport the water away after pressing without allowing it to migrate back into the web. In pressing, the paper web is conveyed on the felt to a gap between two rolls, i.e. so-called nip. Typically, there are one to four nips in succession, and in each nip water is pressed out of the web into the felt. Consequently, the felt should be such that the water can well be absorbed into the felt pressed in the roll nip. The press felts comprise a base fabric that provides the felt with a necessary space for water, for instance. To make the felt surface smooth, batt fibre is needled onto a base fabric surface facing the paper web. The batt fibre thus prevents markings from being produced on the web to be drained. In addition, by means of the batt fibre the water retention capacity of the felt can be adjusted to a desired level such that water is prevented from migrating back from the felt into the web, i.e. so-called rewetting is prevented. Further, the press felt should endure pressing, in order not be permanently compressed, and thereafter, easily blocked.

Even though non-woven arrays of yarns and corresponding structures have also been developed, the base fabric of the press felt is still typically manufactured by weaving, because better stability is achieved by a woven structure.

Further, weaving allows better formation of a base fabric to suit each purpose, because there are more structural alternatives. Several alternative ways to weave the base fabric are known. The base fabric can be woven on a weaving machine directly into an endless loop. In that case, the weft yarns, transversal while being woven, are in the machine direction during use on the paper machine, whereby the width of the weaving machine limits the length of the base fabric to be manufactured. Using this technique, it is difficult to manufacture sufficiently long base fabrics for all press types. Further, it is possible to weave base fabrics provided with seam loops, and a necessary number of the base fabrics can be connected to form a closed loop. The seam loops at the ends of the base fabrics to be connected are intermeshed and engaged by inserting a seam yarn in a channel formed by the seam loops. The base fabric with seam loops can be woven by the known methods as flat weaving or horseshoe weaving. When woven as a plane, the weft yarns form seam loops on both edges of the fabric. Horseshoe weaving, in turn is carried out endless, so that only one edge of the fabric is provided with seam loops formed by weft yarns. Thus the base fabric can be assembled from a plurality of flat, or correspondingly, horseshoe portions, which are interconnected at their ends to form one longer entity. The press felts with seam loops have a drawback that at the seam the base fabric is different from other portions, whereby the properties of the felt at the seam area are different. In addition, the attachment of the batt fibre to the base fabric is difficult at the seam loop area, where yarn density is lower. During use, the felt is subjected to tensile stress, because of which the seam area, in particular, tends to deform. This weakens the adherence of the batt fibre even further and affects the permeability properties of the seam area.

BRIEF DESCRIPTION OF THE INVENTION

The object of the present invention is to provide a novel and improved press felt for a paper machine, a base fabric and a method of manufacturing the press felt.

The method of the invention is characterized by arranging, in assembling the base fabric, prior to batt fibre attachment, transverse jointing edges of one or more base fabric modules edge on edge, substantially closely against one another, and connecting them at the resulting butt seam to form a closed loop.

Further, the press felt of the invention is characterized in that the base fabric modules to be connected are substantially as wide as the press felt and that, prior to attaching the batt fibre, the transverse jointing edges of the base fabric modules are arranged with a butt seam edge on edge, substantially closely against one another, to form a closed loop of a desired length.

Further still, the base fabric of the invention is characterized in that the base fabric modules to be connected are substantially as wide as the press felt and that the transverse jointing edges of one or more base fabric modules are arranged with a butt seam edge on edge, substantially closely against one another, and connected at the butt seam to form a closed loop of a desired length.

The basic idea of the invention is to form a base fabric having a laminated structure for the press felt, i.e. multilayered base fabric having at least two superimposed, independent layers. Each of these independent layers comprises weft yarns and warp yarns of its own. According to the inventive idea, the base fabric is assembled of one or more base fabric modules to form a closed loop of a desired length. For assembly, at least one base fabric module edge, transverse to the paper machine direction, is provided with a jointing edge. On assembly, the jointing edges of one or more base fabric modules are interconnected with a butt seam. Each of the base fabric portions to be connected is substantially as wide as the press felt, i.e. seen in the lateral direction the press felt is continuous. Typically, one or more batt fibre layers are attached to the base fabric, preferably by needling.

Thanks to the butt seam according to the invention, the properties in the seam area of the laminated base fabric now substantially correspond to those in the rest of the base fabric. Thus, the base fabric can be formed more freely than before of a plurality of different base fabric modules. It is possible to form the base fabric modules by different solutions, as regards the shape, the yarn material, the dimensions and the thread count, the weave, the number of superimposed laminated layers, etc., whereby different base fabrics can be customized for different press sections.

In general, the laminated felts have an advantage that it is easier to provide the laminated felts with a sufficient space for water, but nevertheless an even surface. Moreover, the laminated felts remain longer unclogged. The distribution of pressure is more even in the laminated felts, and consequently they are less liable to permanent compression. In the laminated felt the compression of the batt fibre is no longer so critical a factor as previously Further, when the laminated felt is used, less vibration occurs in the press section, because variations in the felt thickness are smaller.

According to an embodiment of the invention, one or more base fabric modules are interconnected by overlapping the connecting portions provided in their jointing edges. For said lap seam the first and the second jointing edges of the base fabric modules to be connected are provided with a seam area, where the independent layers of the module form at least two connecting portions of different lengths. The connecting portions of different lengths are in inverted positions in the first and the second edges to be connected such that, on assembly, the connecting portions of the first edge and the connecting portions of the second edge fit edge on edge against one another to form a butt seam. Thus, the connecting portions of the first and the second jointing edges are in an alternating order in the seam area, and therefore the butt seams between the connecting portions are at different points in the seam area in the plane of the base fabric. Thanks to the lap seam, the butt seam between the base fabric modules becomes sufficiently strong, and hence it resists well the loading, to which the felt is subjected when the machine is run. The needled batt fibre binds the overlapping connecting portions.

According to an embodiment, one or more separate base fabric modules are interconnected by means of a lap seam at their cross machine direction ends. Thus is obtained one continuous closed loop, which is longer than individual base fabric modules. The solution expedites and facilitates the manufacture of press felts, because a base fabric preform can be woven in advance into a long mat, which will be cut to a desired size for a base fabric module. It is relatively easy and quick to provide the ends of the module with seam areas for assembly according to the invention.

The basic idea of an embodiment of the invention is that the base fabric of the press felt is woven in a plane form, whereby the weaving direction and the running direction of the fabric on the paper machine remain the same. Further, the base fabric comprises two or more superimposed, independent layers, which are woven simultaneously on the same weaving machine, each independent layer comprising its own yarn system such that the layers can be detached, if desired, from one another to form separate components. Each independent layer may have the same or different weave with respect to the other layers, likewise the yarn density, material, cross section and dimensions can be the same or different in each layer. During the weaving process of the base fabric the layers are bound together at desired intervals with a weft- or warp-oriented binding yarn system separate from the yarn systems of the layers. Alternatively, a necessary number of single weft or warp yarns of one or more independent layers may travel at predetermined intervals between two or more layers and thus bind the independent fabric layers together in the desired manner. The base fabric preform can be woven directly into a module of a predetermined length, or the base fabric preform can be woven into a continuous strip, wherefrom the base fabric modules of desired length are cut. A seam area of various layers of the base fabric is provided at both transverse ends of the base fabric module. For making a seam, the binding between the superimposed layers is released by cutting the yarns that bind the layers together and by removing said yarns from a predetermined portion at both ends of the base fabric. Thereafter the different layers are detached from one another for the length of the seam area. The detached superimposed layers are cut in a preplanned manner with respect to one another into at least two connecting portions of different lengths. The opposing module ends are cut to be mirror images of one another. An advantage with the above-described solution is that the base fabric can be woven flat, which allows the use of a simpler weaving machine which is also faster than the weaving machines suitable for flat weaving. Flat weaving also provides a better possibility to customize the structure of the base fabric, because it is not connected with the shuttle rotation of the weaving machine. Moreover, because the weaving direction and the running direction of the flat woven base fabric are the same, it is possible to utilize the advantages of the warp-dominating fabric. The warp yarns can be flattened, their number can be great, and the yarn interlacing can be selected such that the surface of the base fabric becomes even.

The basic idea of an embodiment of the invention is that the base fabric of the press felt comprises at least one first base fabric module ready-woven into a closed loop and at least one second base fabric of a planar shape. The first and the second base fabric modules comprise one or more layers and their weave and yarns are suitably selected. The first and the second base fabric modules are superimposed, and the transverse jointing edges of the second, planar base fabric module are interlinked with a butt seam. There can be a plurality of base fabric modules woven into a loop as well as flat-woven modules, and further, they can be arranged one on top of the other in a desired manner. An advantage with this base fabric structure is that the loop-woven base fabric module receives the machine direction loading, to which the base fabric is subjected. The flat woven base fabric modules, in turn, contribute to the properties of the base fabric surface, as well as to the water volume, density, etc. In addition, the planar module is easy to manufacture by flat weaving.

It should be noted that in the present application the butt seam refers to a transverse base fabric seam, in which two layers in the same plane are arranged edge on edge, and the jointing edges, transverse to the plane surface of the base fabric, are disposed substantially closely against one another without any seam loops or like securing means, whereby the seam area substantially corresponds to the structure in the rest of the base fabric.

BRIEF DESCRIPTION OF THE INVENTION

The invention will be described in greater detail with reference to the attached drawings, wherein FIG. 1 is a schematic view of a press felt according to the invention cut open in the direction of warp yarns;

For clarity, the figures are highly simplified. Like reference numerals refer to like parts.

DETAILED DESCRIPTION OF THE INVENTION

Figure 1:
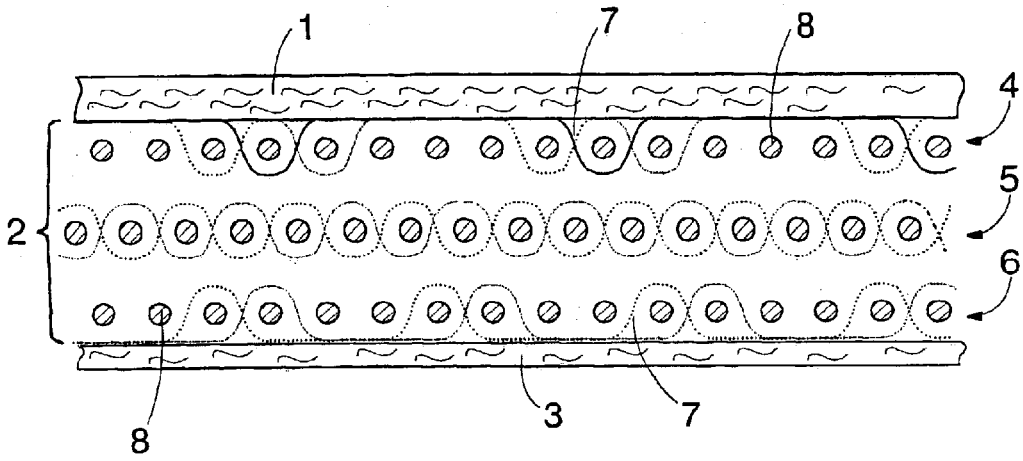

FIG. 1 shows a structure of a press felt according to the invention, cut open in the direction of warp yarns. The press felt comprises three interlinked layers, of which the topmost layer, i.e. the one facing the web, is a batt fibre layer 1. Beneath the batt fibre layer there is a base fabric 2 and in the lowest position there is still one batt fibre layer 3. The web-side batt fibre 1 prevents markings, i.e. patterning resulting from the base fabric texture, from being produced on the surface of the paper web. Typically, the batt fibre layer consists of at least two thinner layers to be needled separately one on top of the other. On the top surface of the batt fibre layer there is, in general, finer batt fibre and coarser batt fibre at the bottom. A batt fibre layer is not necessary at the bottom of the press felt. The base fabric 2 of the press felt is manufactured of warp yarns and weft yarns by weaving. In general, the base fabric has relatively loose texture in order to provide a sufficient space for water, and suitable openness. The laminated base fabric shown in the figure comprises three superimposed independent layers 4, 5 and 6. Each layer comprises specific warp yarns 7 and weft yarns 8, which interlace in the desired manner. For clarity, the figures of the application only show a few yarns of the weave. The laminated base fabric can be manufactured as shown in FIG. 15*a* such that two or more separate base fabric preforms are woven in separate steps, and the resulting preforms are arranged one on top of the other and, if desired, stitched together, for instance, to form one piece. Alternatively, the laminate is produced in one step by weaving as in FIGS. 2 to 4.

Figure 2:
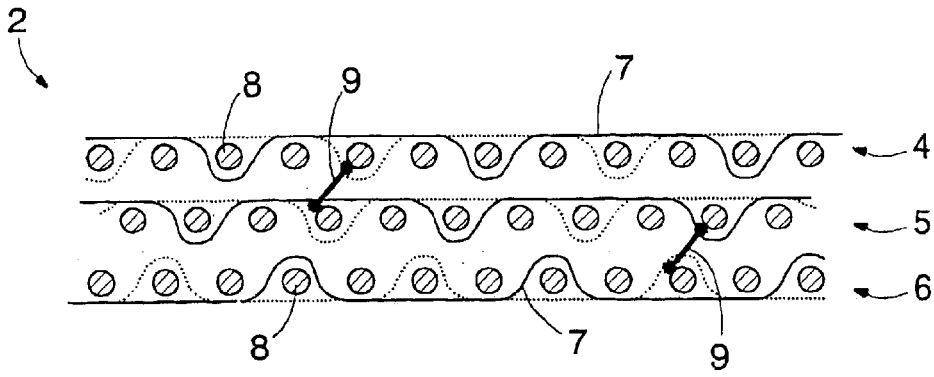
FIGS. 2 to 4 are schematic views of base fabrics of the press felt according to the invention cut open in the direction of the warp yarns.

FIG. 2 shows a second base fabric 2 according to the invention. As in FIG. 1, the base fabric comprises three independent superimposed layers 4, 5 and 6. This base fabric is woven on one weaving machine and in one step, whereby manufacturing is fast. Each independent layer of the base fabric comprises its own weft yarns 8 and warp yarns 7, whereby the layers are detachable without disintegrating their actual structure. As appears from FIGS. 1 and 2, the warp yarns and weft yarns of different layers may interlace differently or identically. Likewise, the yarn density, dimensions and material can be selected separately for each layer. During weaving, the layers 4, 5 and 6 are bound together with binding yarns that are independent of the yarn systems of the layers. Regarding the structure of a single layer, the binding yarns are extra yarns. The binding yarns interlace between the superimposed layers and bind the independent layers of the base fabric into a whole, i.e. into a base fabric preform, out of which the base fabric of desired dimensions can be made. In the figure, the layers are bound with weft direction binding yarns 9. After weaving, the base fabric preform can be treated with heat. Alternatively, the heat treatment can be performed on the modules made of the base fabric preforms or on the base fabric loop just before attaching the batt fibre.

Figure 3:
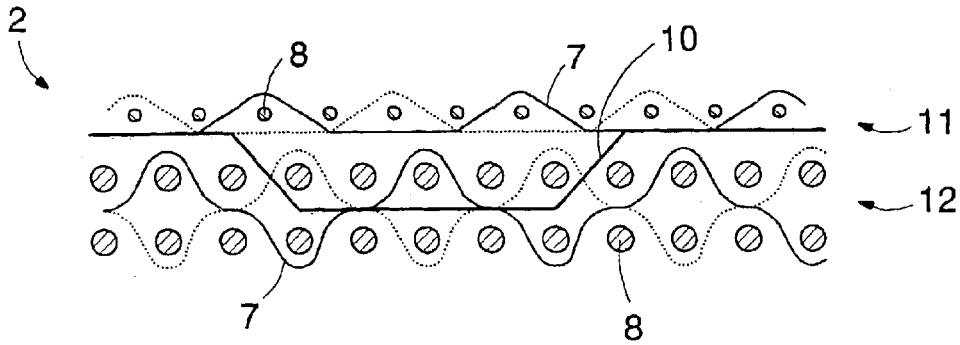

The base fabric of FIG. 3 comprises two independent superimposed layers 11 and 12, of which the lower one comprises two plies and the upper one comprises one ply. The independent layers are further bound together with warp direction binding yarns 10.

Figure 4:
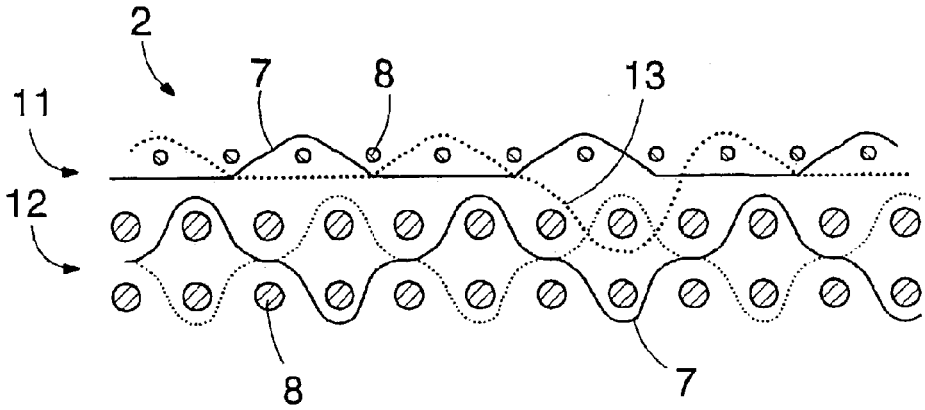

FIG. 4 shows a base fabric, which comprises two superimposed layers 11 and 12. As appears from the figure, the upper layer 11 consists of yarns, whose dimensions differ substantially from those in the lower layer 12. In flat weaving, the ratio of the yarn cross sections can be as high as 10 to 1, for instance. Further, the upper layer comprises weft yarns 8 in one ply, whereas the lower layer is a two-ply weave with weft yarns 8 in two plies. The layers of the base fabric are now interlinked by means of single warp yarns 13 interlacing in accordance with the yarn system of the upper layer 11. A predetermined number of upper-layer warp yarns 13 are arranged to pass through the lower-layer weft yarns 8 at suitable intervals during weaving. Alternatively, it is also possible to use lower-layer yarns in the binding. The yarns interlacing between the layers can also be weft yarns.

Figure 5:
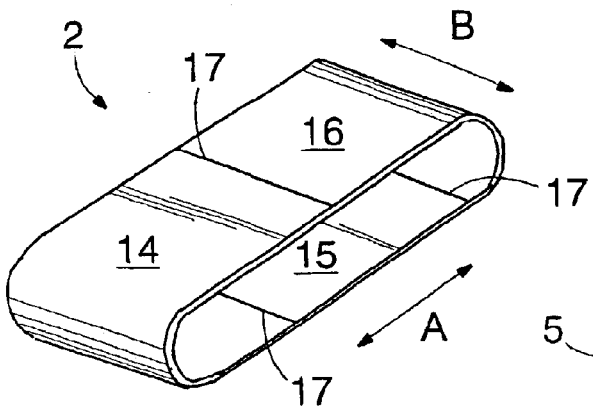
FIG. 5 is a schematic view, seen in perspective, of a base fabric according to the invention.

FIG. 5 shows a base fabric 2 in the form of a closed loop. The base fabric of the figure is formed by assembling three separate base fabric modules 14, 15 and 16 in a longitudinal direction A, on the extensions of one another, to form a sequence of three modules, whereafter the outermost ends of the sequence are interconnected. This results in a closed loop. Naturally, the properties of the modules to be connected in sequence are identical. In some cases it is advantageous to form the base structure by using only one base fabric module and one transverse butt seam, whereby the base structure comprises the lowest possible number of discontinuities. When the base fabric is assembled, the transverse B edges of the base fabric modules, which edges are designed in accordance with the invention, are arranged edge on edge against one another, whereby the portions formed of the different module layers will be interlocked at a seam area 17. Thereafter, the base fabric modules are interconnected at the seam area so that the handling of the base fabric becomes easier, and the necessary batt fibre layers can be attached to the base fabric, advantageously by needling. The connection of the base fabric modules at the seam area can be carried out, for instance, with suitable stitches, by ultrasound welding, gluing, melting or any other suitable manner, however, without any locking means belonging to the structure of the base fabric modules. The connection should hold the ends of the base fabric modules immovably in place at least until the needling of the batt fibre is completed. The needling of the batt fibre, together with the above-mentioned pre-connection, gives the seam its final strength. On the other hand, batt fibre alone may be sufficient to lock the seam, whereby the preforms can also be interconnected with soluble materials, for instance, by using a binding yarn or film made of a water soluble polymer, or a soluble glue. Because no shape-locking or other particular locking means are used, the properties in the seam area are substantially the same as in the rest of the felt.

Figure 6:
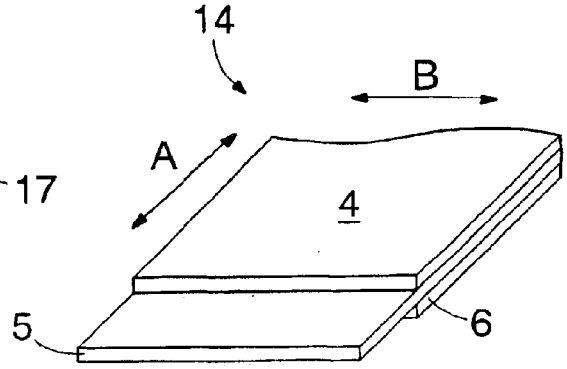
FIG. 6 is a schematic view, seen in perspective, of a structural alternative of a base fabric module end according to the invention.

FIG. 6 shows a male end of the base fabric module consisting of three different layers, in which the intermediate layer 5 extends longer than the outer layers 4 and 6 in the longitudinal direction A of the base fabric module. Correspondingly, at the opposite end of the preform, which is not shown, the outer layers extend longer than the intermediate layer. Of the base fabric modules formed in this manner it is possible to assemble an endless base fabric that is longer than the individual modules. The base fabric modules can be made according to a suitable dimensioning scale, whereby ready-made base fabric modules of various lengths can be assembled into base fabrics of various lengths.

The jointing edge shown in FIG. 6 can be formed, for instance, by offsetting two or more separately woven, independent base fabric layers in superimposition for a predetermined distance, whereby the transverse, opposite edges of the laminate are provided with connecting portions of different lengths for the lap seam.

Figure 7:
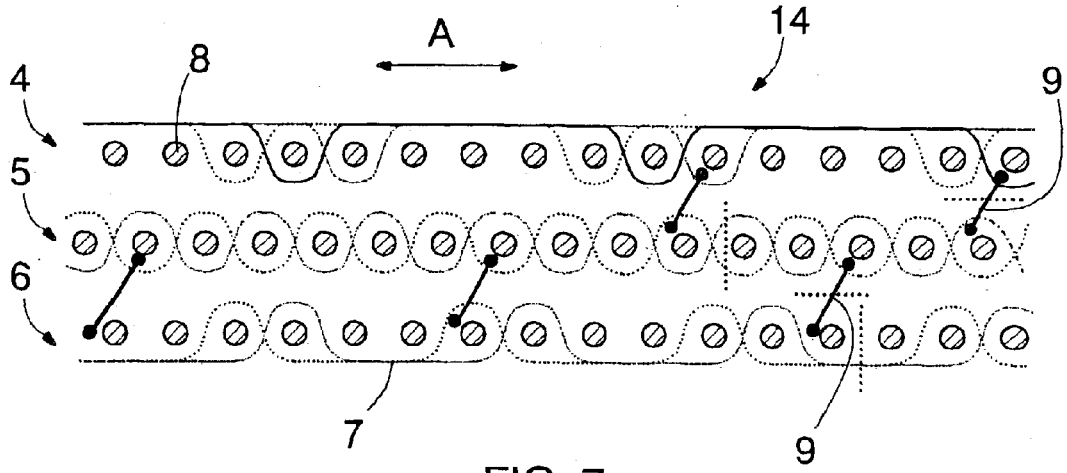
FIGS. 7 to 9 are schematic views of lap seam formation according to the invention at transverse ends of the base fabric module.
Figure 8:
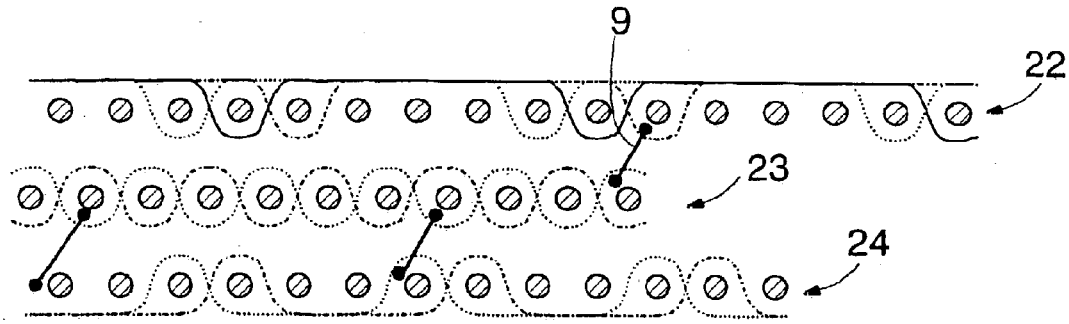
Figure 9:
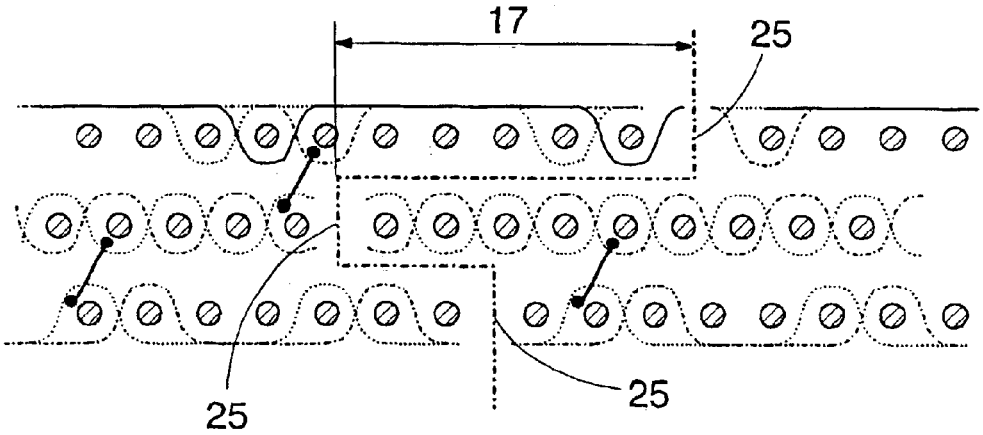

FIGS. 7 to 9 show a method of providing a jointing edge according to the invention at a transverse edge of the base fabric module and interconnecting two base fabric modules in the longitudinal direction A. By means of this jointing edge one or more modules can be connected with a butt seam to form a closed loop of a desired length. A base fabric preform consisting of three independent layers 4, 5 and 6 is woven on the weaving machine in one step. The base fabric is woven directly into a module of the desired length, or alternatively, a base fabric module of a suitable length is cut from a longer strip. Thereafter, a jointing edge is provided at the transverse ends of the module 14 by detaching the superimposed layers for a predetermined length at the module end. In the structure of the figure, the superimposed layers are interlinked by means of separate binding wefts 9, which are now cut at points indicated by a broken line and removed from the jointing edge section. Thereafter, the layers are cut such that at least two portions of different lengths are provided at the module end. In the solution of FIG. 8, each module layer is cut to form a connecting portion of different length: the topmost connecting portion 22 is longest and the midmost connecting portion 23 is shortest. As appears from FIG. 9, a second module end to be connected to the first end of FIG. 8 is designed to be inverted: the topmost connecting portion is shortest and the midmost connecting portion is longest. When the ends of the module(s) are fitted against one another as in FIG. 9, the connecting portions of different lengths in the different modules are interlocked and the butt seams 25 of the opposing portions in each layer are offset in the longitudinal direction of the module. Hence, the structure of the seam area 17 is substantially similar to the rest of the base fabric.

Figure 10B:
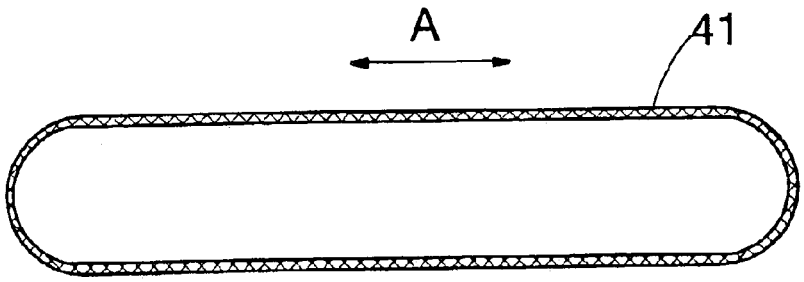
FIG. 10*a* is a schematic view of the base fabric according to the invention, which is assembled of the base fabric modules of FIGS. 10*b* and 10*c*.
Figure 10C:
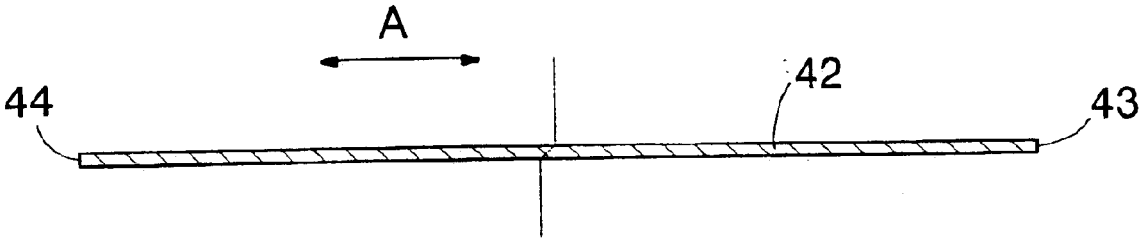
Figure 10A:
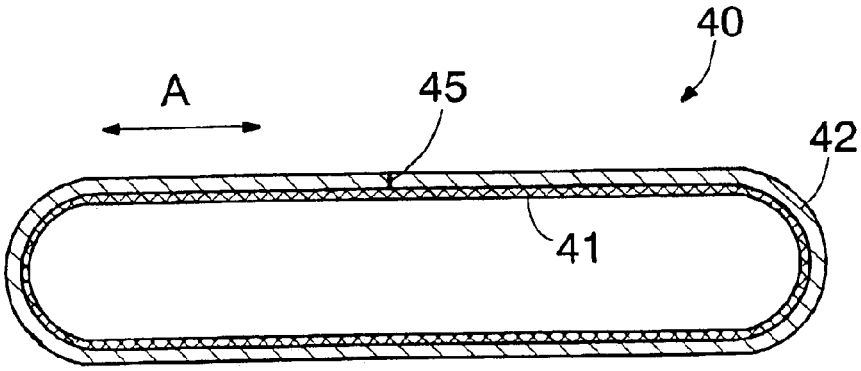

FIG. 10*a* is a side view of yet another base fabric according to the invention. The base fabric 40 is made of a first base fabric module 41 woven into a closed loop and of a second base fabric module 42, which is planar in shape, as in FIG. 10*c*. Advantageously, the flat-woven second base fabric module 42 is arranged on top of the first base fabric module 41 woven in horseshoe form, whereafter the transverse jointing edges 43 and 44 of the second base fabric module are interconnected with a butt seam 45. Thereafter, the seam is strengthened with a suitable pre-connection, such as stitches passing through the first and the second layers, ultrasound welding or by means of a soluble film. The structure has an advantage that the first base fabric module 41 receives well the loads to which the felt is subjected when the machine is run, and consequently it is possible to influence the other properties of the base fabric, such as density and surface properties, by means of the second base fabric module 42. The flat-woven second base fabric module 42 is easier to manufacture and it allows a wide variety of structures and properties. Unlike in FIG. 10*a*, there can be a plurality of loop-woven and planar base fabric modules attached to form a laminated structure. Further, the base fabric modules can be superimposed in a desired manner, for instance, in the following manner: one or more planar base fabric modules are arranged on both the upper surface side and the lower surface side of the entity consisting of one or more loop-like base fabric modules. It is also possible to superimpose alternately a desired number of planar base fabric modules and loop-like base fabric modules.

The drawings and the relating specification are only intended to illustrate the inventive idea. The details of the invention may vary within the scope of the claims.

What is claimed is:

1. A method of manufacturing a press felt, comprising:

forming a laminated base fabric having at least two superimposed, independent, woven layers, each layer having its own warp yarns and weft yarns;

weaving the independent layers in a base fabric preform of a press felt in one step;

binding the independent layers together during weaving by one or more yarns interlacing between the independent layers, the yarns being separate from the bound independent layers;

manufacturing at least one base fabric module having a first jointing edge, the first jointing edge having at least two connecting portions of different lengths formed from the independent layers of the base fabric preform;

wherein the first jointing edge is formed, after the weaving, by cutting and removing the yarns binding the independent layers from the area of the first jointing edge;

detaching the independent layers of the base fabric perform from one another at the first jointing edge;

cutting the independent layers at the first jointing edge into the at least two connecting portions of different lengths for a lap seam;

providing connecting portions at a second jointing edge to be inverted relative to the first jointing edge, such that the at least two connecting portions of the first jointing edge and the connecting portions of the second jointing edge oppose each other;

assembling the base fabric preform from the at least one base fabric module into one closed loop;

arranging, on assembly and prior to batt fiber attachment, the opposing connecting portions of the first and the second jointing edges, edge on edge, against one another, and connecting them at a resulting butt seam to form a closed loop, whereby the connecting portions overlap and the butt seams in adjacent connecting portions are offset in the planar direction of the base fabric module; and attaching at least one batt fiber layer to the base fabric after assembly.

2. The method according to claim 1, comprising assembling the base fabric of one base fabric module.

3. The method according to claim 1, comprising interconnecting the first and second jointing edges of the base fabric modules in the vicinity of the butt seam so that the first and second jointing edges hold immovably in place with respect to one another in the planar direction of the base fabric at least until the needling of the at least one batt fibre fiber layer.

4. The method according to claim 1, comprising:

weaving one or more base fabric modules having the form of a closed loop;

weaving one or more planar base fabric modules;

arranging the one or more planar base fabric modules at least on one surface of one of the base fabric modules having the form of a closed loop; and connecting transverse jointing edges of the planar base fabric modules edge on edge and connecting them with a butt seam into a closed loop.

5. A method of manufacturing a press felt, comprising:

forming a laminated base fabric having at least two superimposed, independent, woven layers, each layer having its own warp yarns and weft yarns;

weaving the independent layers in a base fabric preform of a press felt in one step;

binding the independent layers of the base fabric perform during weaving by at least one of a warp-direction binding yarn and a weft-direction binding yarn, the at least one of the warp-direction binding yarn and the weft-direction binding yarn being separate from the bound independent layers;

manufacturing at least one base fabric module having a first jointing edge, the first jointing edge having at least two connecting portions of different lengths formed from the independent layers of the base fabric perform;

wherein the first jointing edge is formed, after the weaving, by cutting and removing the at least one of the warp-direction binding yarn and the weft-direction binding yarn that binds the independent layers from the area of the first jointing edge;

detaching the independent layers of the base fabric perform from one another at the first jointing edge;

cutting the independent layers at the first jointing edge into the at least two connecting portions of different lengths for a lap seam;

providing connecting portions at a second jointing edge to be inverted relative to the first jointing edge, such that the at least two connecting portions of the first jointing edge and the connecting portions of the second jointing edge oppose each other;

assembling the base fabric preform from the at least one base fabric module into one closed loop;

arranging, on assembly and prior to batt fiber attachment, the opposing connecting portions of the first and the second jointing edges, edge on edge, against one another, and connecting them at a resulting butt seam to form a closed loop, whereby the connecting portions overlap and the butt seams in adjacent connecting portions are offset in the planar direction of the base fabric module; and attaching at least one batt fiber layer to the base fabric after assembly.

6. A method of manufacturing a press felt, comprising:

forming a laminated base fabric having at least two superimposed, independent, woven layers, each layer having its own warp yarns and weft yarns;

weaving the independent layers in a base fabric preform of a press felt in one step;

binding the independent layers of the base fabric perform during weaving with single yarns of at least one base fabric layer, which yarns run at predetermined intervals through the basic yarns of at least two different independent layers;

manufacturing at least one base fabric module having a first jointing edge, the first jointing edge having at least two connecting portions of different lengths formed from the independent layers of the base fabric preform;

wherein the first jointing edge is formed, after the weaving, by cutting and removing the yarns binding the independent layers from the area of the first jointing edge;

detaching the independent layers of the base fabric perform from one another at the first jointing edge;

cutting the independent layers at the first jointing edge into the at least two connecting portions of different lengths for a lap seam;

providing connecting portions at a second jointing edge to be inverted relative to the first jointing edge, such that the at least two connecting portions of the first jointing edge and the connecting portions of the second jointing edge oppose each other;

assembling the base fabric preform from the at least one base fabric module into one closed loop;

arranging, on assembly and prior to batt fiber attachment, the opposing connecting portions of the first and the second jointing edges, edge on edge, against one another, and connecting them at a resulting butt seam to form a closed loop, whereby the connecting portions overlap and the butt seams in adjacent connecting portions are offset in the planar direction of the base fabric module; and attaching at least one batt fiber layer to the base fabric after assembly.

7. A press felt, comprising:

a woven base fabric and at least one batt fiber layer, the base fabric comprising at least one base fabric module having at least two superimposed, independent layers, each layer having its own warp yarns and weft yarns, wherein the independent layers of the base fabric module are woven simultaneously on one weaving machine, and the independent layers of the base fabric module are bound together during weaving by one or more yarns interlacing between the independent layers, the yarns being separate from the bound independent layers, the base fabric module being provided with jointing edges, to which other base fabric modules are joined to form a closed loop base fabric, wherein the jointing edges are formed after weaving by cutting the independent layers into at least two connecting portions of different lengths for a lap seam, wherein the base fabric modules to be connected are substantially as wide as the press felt, wherein the jointing edges of the base fabric modules are arranged against one another, edge on edge, with a butt seam, whereby the connecting portions overlap and further wherein the at least one batt fiber layer is attached to the closed loop base fabric.

8. The press felt according to claim 7, wherein the at least two connecting portions of different lengths are provided from the independent layers of the base fabric at the first jointing edge to be connected, and correspondingly, at the second jointing edge to be connected there are inverted connecting portions, the first and the second connecting portions are arranged to overlap, and there is a butt seam between the opposing connecting portions of the jointing edges.

9. The press felt according to claim 7, wherein the independent layers of the base fabric module are bound together during weaving with at least one of a warp-direction binding yarn and a weft-direction binding yarn, the at least one of the warp direction binding yarn and the weft-direction binding yarn being separate from the yarn systems of the independent layers.

10. The press felt according to claim 7, wherein the independent layers of the base fabric module are bound together during weaving with at least one of a single weft and a warp yarn which belong to the yarn system of at least one independent layer and which are arranged to travel at predetermined intervals between the basic yarns of at least two independent layers.

11. The press felt according to claim 7, wherein the press felt comprises one base fabric module in the a longitudinal direction of the press felt, which module is connected at its transverse ends into a closed loop.

12. The press felt according to claim 7, wherein the base fabric comprises superimposed at least one base fabric module woven into a closed loop and at least one planar base fabric module, which planar base fabric module is connected with a butt seam into a closed loop.

13. A base fabric, comprising:

at least one base fabric module having at least two superimposed, independent layers, each layer having a plurality of warp yarns and weft yarn;

wherein the independent layers of the base fabric module are woven simultaneously on one weaving machine, and the independent layers of the base fabric module are bound together during weaving by one or more yarns interlacing between the independent layers, the yarns being separate from the bound independent layer, the at least one base fabric module is provided with jointing edges, to which other base fabric modules are connected to form a closed loop base fabric, wherein the jointing edges are formed after weaving by cutting the independent layers into at least two connecting portions of different lengths for a lap seam, wherein the base fabric modules to be connected are substantially as wide as the press felt, and wherein the jointing edges of one or more base fabric modules are arranged with a butt seam, edge on edge, against one another and connected at the butt seam into a closed loop of a desired length.

* * * * *